US011501934B2

(12) United States Patent
Weidner et al.

(10) Patent No.: US 11,501,934 B2
(45) Date of Patent: Nov. 15, 2022

(54) KEY ARRANGEMENT EMPLOYING MECHANICAL AND MAGNETIC FORCES

(71) Applicant: Dr. Ing. h.c. F. Porsche Aktiengesellschaft, Stuttgart (DE)

(72) Inventors: Michael Weidner, Rheinstetten (DE); Manuel Kuehner, Kornwestheim (DE)

(73) Assignee: Dr. Ing. h.c. F. Porsche Aktiengesellschaft, Stuttgart (DE)

( * ) Notice: Subject to any disclaimer, the term of this patent is extended or adjusted under 35 U.S.C. 154(b) by 392 days.

(21) Appl. No.: 16/751,217

(22) Filed: Jan. 24, 2020

(65) Prior Publication Data

US 2020/0243284 A1 Jul. 30, 2020

(30) Foreign Application Priority Data

Jan. 28, 2019 (DE) ..... 10 2019 101 961.3

(51) Int. Cl.
*H01H 23/16* (2006.01)
*H01H 23/24* (2006.01)

(52) U.S. Cl.
CPC ..... *H01H 23/16* (2013.01); *H01H 23/24* (2013.01); *H01H 2221/04* (2013.01); *H01H 2233/05* (2013.01)

(58) Field of Classification Search
CPC ..... H01H 23/16; H01H 23/24; H01H 221/04; H01H 2233/05; H01H 2215/042; G05G 5/03; G05G 5/04; G05G 5/05
See application file for complete search history.

(56) References Cited

U.S. PATENT DOCUMENTS

| | | | | |
|---|---|---|---|---|
| 3,644,856 | A | 2/1972 | Scott | |
| 6,670,873 | B2 | 12/2003 | Inada et al. | |
| 7,233,220 | B2 * | 6/2007 | Batteux | H01H 51/01 335/229 |
| 2011/0093526 | A1 | 4/2011 | Liue | |
| 2013/0154940 | A1 | 6/2013 | Gan et al. | |
| 2020/0168410 | A1 * | 5/2020 | Lin | H01H 13/14 |

FOREIGN PATENT DOCUMENTS

| | | | |
|---|---|---|---|
| DE | 102012112628 | A1 | 7/2013 |
| DE | 202015103208 | U1 | 6/2015 |
| WO | WO 08502487 | A1 | 6/1985 |
| WO | WO 2007069026 | A1 | 6/2007 |
| WO | WO 2014175565 | A1 | 10/2014 |

* cited by examiner

*Primary Examiner* — Vanessa Girardi
(74) *Attorney, Agent, or Firm* — Leydig, Voit & Mayer, Ltd.

(57) ABSTRACT

A key arrangement includes an activation element, a switch, a mechanical counterforce generating device, and a permanent magnet arrangement. The switch has at least a first state and a second state. The activation element has a basic state and an activation state and is configured to, in case of activation by a user, permit a movement from the basic state into the activation state, and in case of the movement into the activation state to permit a change in the state of the switch. The mechanical counterforce generating device is configured to generate, in case of an activation of the activation element, a first counterforce at least in certain areas. The permanent magnet arrangement is configured to generate, in case of activation of the activation element, a second counterforce at least in certain areas.

18 Claims, 3 Drawing Sheets

KEY ARRANGEMENT EMPLOYING MECHANICAL AND MAGNETIC FORCES

CROSS REFERENCE TO RELATED APPLICATIONS

This application claims benefit to German Patent Application No. DE 10 2019 101 961.3, filed Jan. 28, 2019, which is hereby incorporated by reference herein.

FIELD

The invention relates to a key arrangement and to a steering wheel having such a key arrangement.

BACKGROUND

DE 10 2012 112 628 A1 presents a keyboard in which the key cap is attached to an X-shaped holder, wherein the operating force is influenced by magnetic elements. In the lower position, a contact pin makes contact with a circuit.

U.S. Pat. No. 3,644,856 presents an electronic switching contact in which a resetting force is generated by permanent magnets.

WO 2007/069026 A1 presents a keyboard in which the key cap is held in the upper position by means of magnets which repel one another, as long as the key cap is not pressed downward by the user.

WO 2014/175565 A1 presents a switch arrangement for a horn in which a movable part experiences a resetting force by means of permanent magnets.

US 2011/0093526 A1 presents a portable cloud computing computer having a keyboard in which permanent magnets are used to reset the keys.

DE 20 2015 103 208 U1 presents a switching device for an electric drive, in which switching device an activation element is attracted by a magnet element, in order to apply a resetting force to the activation element.

U.S. Pat. No. 6,670,873 B2 presents a key in which the resetting force is generated by means of permanent magnets, and the movement of the key is sensed by means of a Hall element.

SUMMARY

In an embodiment, the present invention provides a key arrangement including an activation element, a switch, a mechanical counterforce generating device, and a permanent magnet arrangement. The switch has at least a first state and a second state. The activation element has a basic state and an activation state and is configured to, in case of activation by a user, permit a movement from the basic state into the activation state, and in case of the movement into the activation state to permit a change in the state of the switch. The mechanical counterforce generating device is configured to generate, in case of an activation of the activation element, a first counterforce at least in certain areas. The permanent magnet arrangement is configured to generate, in case of activation of the activation element, a second counterforce at least in certain areas.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
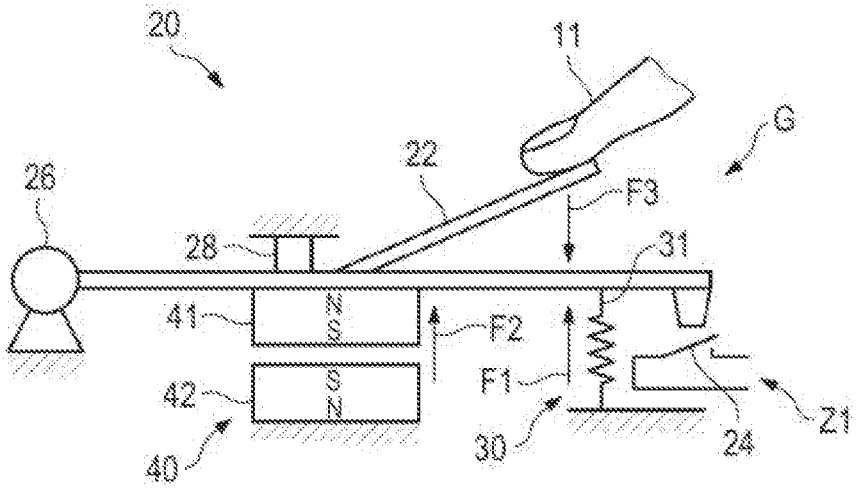
FIG. 1 shows a schematic illustration of an embodiment of a key arrangement in a basic state G.

The present disclosure describes a new key arrangement and a new steering wheel.

The present disclosure describes a key arrangement. The key arrangement has an activation element, a switch, a mechanical counterforce generating device and a permanent magnet arrangement, which switch has at least a first state and a second state, which activation element has a basic state and an activation state and is designed, in the case of activation by a user, to permit a movement from the basic state into the activation state, and in the case of the movement into the activation state to permit a change in the state of the switch, which mechanical counterforce generating device is designed to generate, in the case of an activation of the activation element, a first counterforce at least in certain areas, and which permanent magnet arrangement is designed to generate, in the case of activation of the activation element, a second counterforce at least in certain areas.

By providing two devices for generating a counterforce, on the one hand the safety is increased and, in particular in the case of a malfunction of the permanent magnet arrangement, the key arrangement remains functionally capable. In addition, a positive force/travel behavior can be achieved through the combination. The permanent magnet arrangement permits a high counter force with a small installation space. A further advantage of the permanent magnet arrangement is that it does not rise to additional friction, or only to a small amount of additional friction, which in certain applications is experienced as negative by the user. In addition, the permanent magnet arrangement can operate quietly. Therefore, preferably no additional disruptive noises are produced.

According to one preferred embodiment, the mechanical counterforce generating device is designed to generate the first counterforce at least so intensively that in the case of non-activation the activation element is moved into the basic state even without the second counterforce. This ensures reliable functioning of the key arrangement even if the permanent magnet arrangement does not generate a counterforce.

According to one preferred embodiment, the mechanical counterforce generating device is designed to generate the first counterforce in such a way that it is non-linear over the movement profile from the basic state of the activation element to the activation state. The provision of a non-linear counterforce has proven itself to be to be able to be used well and haptically advantageous.

According to one preferred embodiment, the permanent magnet arrangement has a first permanent magnet and a second permanent magnet, which first permanent magnet is connected to the activation element, and which second permanent magnet is arranged in such a way that it interacts with the first permanent magnet, and in the case of movement of the activation element a movement of the first permanent magnet takes place relative to the second permanent magnet. The second counterforce can be advantageously generated by means of the two permanent magnets.

According to one preferred embodiment, the first permanent magnet is arranged relative to the second permanent magnet in such a way that the first permanent magnet and the second permanent magnet attract one another and in that in the case of movement of the activation element from the basic state into the activation state the first permanent magnet and the second permanent magnet move away from one another, at least in certain areas. By means of this arrangement it is possible to generate in the case of activation a second counterforce which decreases with the travel, and in particular at the start of the activation it is possible to achieve an increase in the necessary force. This also reduces the risk of inadvertent activation of the key arrangement.

According to one preferred embodiment, the first permanent magnet is arranged relative to the second permanent magnet in such a way that the first permanent magnet and the second permanent magnet repel one another, and in that in the case of movement of the activation element from the basic state into the activation state the first permanent magnet and the second permanent magnet move toward one another at least in certain areas. By means of such an arrangement, the necessary force for the activation can be increased, in particular toward the end of the activation.

According to one preferred embodiment, the activation element is embodied as a rocker key. Rocker keys can be used for mechanically highly stressed operator control elements, for example for a steering wheel. Owing to their use as rocker keys for the gearshift, such rocker keys are also referred to as rocker switches.

According to one preferred embodiment, a mechanical stop is provided which in the basic state limits the movement of the activation element from the activation state to the basic state. As a result of the provision of the stop, the basic state is securely and precisely defined.

According to one preferred embodiment, the mechanical counterforce generating device has an elastic element, in order to at least partially generate the first counterforce. The provision of the elastic element permits the key arrangement to be reset without an additional drive or actuator.

According to one preferred embodiment, the elastic element has a spring element. Spring elements function well and reliably for resetting the key arrangement. According to one preferred embodiment, the mechanical counterforce generating device has a damping element, in order to damp a movement of the activation element from the basis state into the activation state, wherein the damping element preferably has a hydraulic damping element, a pneumatic damping element or a friction damping element. The provision of a damping element can take place in order to protect the key arrangement mechanically against excessively high forces in the case of very strong activation of the key arrangement. In addition it is haptically advantageous to provide at least one low damping means.

According to one preferred embodiment, the switch has a microswitch, a silicone switching mat or a crack disk. These switch types can be provided with integrated mechanical damping and therefore perform a double function.

According to one preferred embodiment, the switch and the mechanical counterforce generating device are embodied as one structural unit. This embodiment facilitates mounting and brings about a reduction in the necessary mounting steps.

According to one preferred embodiment, the mechanical counterforce generating device and the permanent magnet arrangement are designed to generate the first counterforce and the second counterforce in such a way that together they are so large that a minimum force, which is at least 6 N, preferably at least 8 N, is necessary to move the activation element from the basic state into the activation state. In particular in sports cars, high switching forces are advantageous for reliable operator control, and such large switching forces can be achieved by superimposing the first counterforce and the second counterforce on one another.

The present disclosure additionally describes a steering wheel for a motor vehicle. The steering wheel has a key arrangement such as has been described herein above. In particular, in the case of steering wheels for sports vehicles the operational reliability and the haptics are highly significant. Therefore, the use of the key arrangement there is particularly advantageous.

FIG. 1 shows a key arrangement 20 with an activation element 22, a switch 24, a mechanical counterforce generating device 30 and a permanent magnet arrangement 40. The switch 24 has at least a first state Z1 and a second state Z2. The first state Z1, in which the switch 24 is opened (electrically non-conductive) in the exemplary embodiment is illustrated. The activation element 22 is illustrated in a basic state G, and it can be moved by a user 11 from the basic state G into an activation state B (cf. FIG. 2) by activation with the force F3. By moving the activation element 22 into the activation state B a change is permitted in the state of the switch 24, that is to say, for example, the switch 24 to be closed. In the exemplary embodiment, the mechanical counterforce generating device 30 has an elastic element 31 in the form of a spring element. In the case of an activation of the activation element 22, a first counterforce F1 is generated by the mechanical counterforce generating device 30, at least in certain areas. In the exemplary embodiment, the permanent magnet arrangement 40 has a first permanent magnet 41 and a second permanent magnet 42, which are arranged in a repelling fashion with respect to one another, and in the case of activation of the activation element 22 by the user 11 they generate a second counterforce F2 at least in certain areas. So that the user 11 can move the activation element 22 from the basic state G into the activation state B, he must press on the activation element 22 with an activation force F3 which is at least as high as the sum of the first counterforce F1 and the second counterforce F2.

The activation element 22 is preferably mounted by means of a bearing 26. The bearing 26 can be a fixed bearing, and in this case the movement of the activation element 22 can be effected by means of deformation of the activation element 22. The bearing 26 can also be embodied as a rotary bearing, with the result that the activation element 22 can be operated as a toggle switch. Guides are also possible.

The mechanical counterforce generating device 30 is preferably designed to generate the first counterforce F1 in such a way that it is non-linear over the movement profile from the basic state G of the activation element 22 to the activation state B. Tests have revealed that users consider a non-linear profile to be advantageous and high quality.

The first permanent magnet 41 is preferably connected to the activation element 22, and the second permanent magnet 42 is arranged in such a way that it interacts with the first permanent magnet 41, and in the case of a movement of the activation element 22 a movement of the first permanent magnet 41 relative to the second permanent magnet 42 takes place. In this context, the second permanent magnet 42 can either be attached securely to a housing of the key arrangement 10 or it can be attached to a mechanism which only partially also executes the movement of the activation element 22.

In the arrangement of the permanent magnets 41, 42 which are shown, they move toward one another at least in certain areas in the case of a movement of the activation element 22 from the basic state G into the activation state B. In the course of the movement of the activation element 22 from the basic state F into the activation state B this gives rise at least in certain areas to an increase in the second counterforce F2.

The key arrangement 10 has a mechanical stop 28 which is provided for limiting the movement of the activation element 22 from the activation state B to the basic state G in the basic state G. As a result, a well-defined basic state G is made possible.

Figure 2:
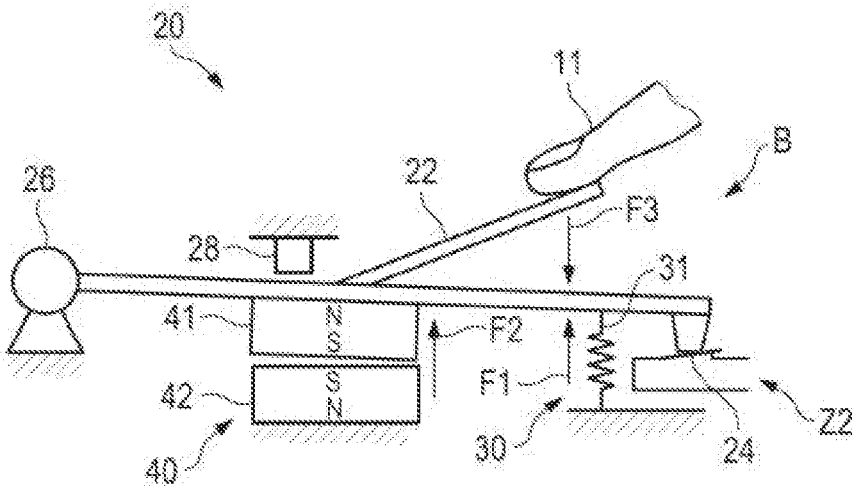
FIG. 2 shows a schematic illustration of the key arrangement from FIG. 1 in an activation state B.

FIG. 2 shows the key arrangement 20 in the activation state B. The activation state 22 is pressed downward, and the activation element 22 has moved the switch 24 into the second state Z2. The switch 24 is closed (electrically conductive) and a current can flow. As a result of the movement of the activation element 22, the first permanent magnet 41 and the second permanent magnet 42 are made to move toward one another, and the spring element 31 is compressed further.

If the user 11 moves his finger away from the activation element 22, the activation element 22 is moved back into the basic state G by the first counterforce F1 and by the second counterforce F2.

Figure 3:
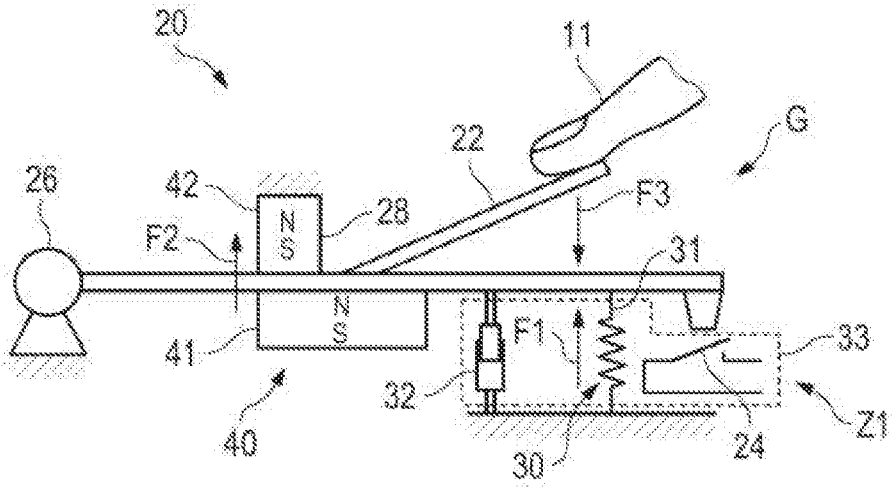
FIG. 3 shows a schematic illustration of a further embodiment of a key arrangement in a basic state G.

FIG. 3 shows a further exemplary embodiment of the key arrangement 20. Elements which correspond to the exemplary embodiment in FIG. 1 have the same reference signs and are not described again.

In contrast to the exemplary embodiment in FIG. 1, the second permanent magnet 42 is arranged on the opposite side and positioned in such a way that the first permanent magnet 41 and the second permanent magnet 42 attract one another. In the case of a movement of the activation element 22 from the basic state into the activation state B, as a result of the arrangement the first permanent magnet 41 and the second permanent magnet 42 move away from one another at least in certain areas. This is advantageous if a large second counterforce F2 is desired in the basic state G, since in the basic state G there is a small distance between the first permanent magnet 41 and the second permanent magnet 42.

In the exemplary embodiment, the second permanent magnet 42 forms the stop 28 at the same time.

A further difference lies in the embodiment of the mechanical counterforce generating device. In addition to the elastic element 31, a damping element 32 is provided in order to damp a movement of the activation element 22 from the basic state G into the activation state B. The damping element 32 is illustrated as a hydraulic damping element, but it can also be embodied as a pneumatic damping element or as a friction damping element.

In the exemplary embodiment, the switch 24 and the mechanical counterforce generating device 31 are embodied as structural unit 33. The switch 24 is preferably embodied as a microswitch, as a silicone switching mat or as a crack disk, or has these elements.

Figure 4:
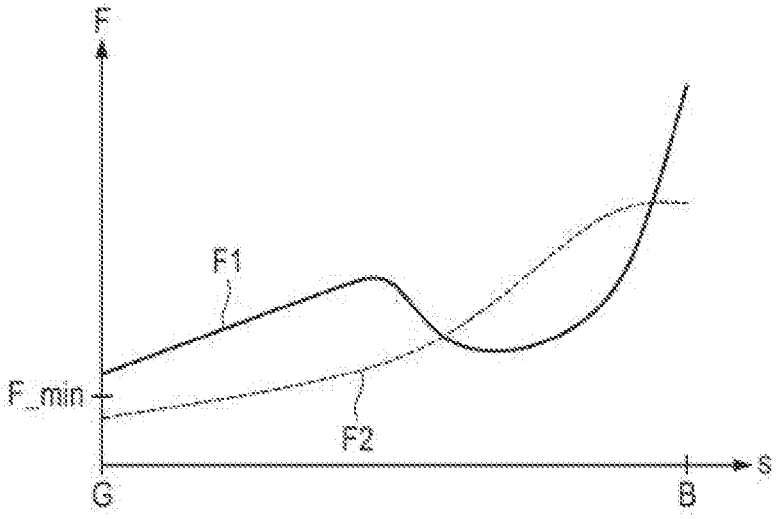
FIG. 4 shows a schematic illustration of a force/travel diagram for the embodiment from FIG. 1.

FIG. 4 shows a diagram in which the force F is illustrated plotted against the travel s of the activation element 22 from the basic state G into the activation state B. The first counterforce F1 of the mechanical counterforce generating device 30 and the second counterforce F2 of the permanent magnet arrangement 40 are shown. The diagrams correspond to the embodiment in FIG. 1 and FIG. 2 in which, in the case of movement of the activation element 22 from the basic state G into the activation state B, the first permanent magnet 41 and the second permanent magnet 42 move toward one another. As a result, the second counterforce F2 increases.

Also shown is a minimum force F_min which is necessary to move the activation element 22 back from the activation state B into the basic state G if the user 11 no longer activates the activation element 22. As can be seen, the first counterforce F1 is larger than the minimum force F_min and therefore the first counterforce F1 of the mechanical counterforce generating device 30 is sufficient to move the activation element 22 into the basic state G. This increases the safety greatly, since even in the case of damage of one of the permanent magnets 41, 42 or in the event of one of the permanent magnets 41, 42 becoming detached it is ensured that the activation element 22 moves back into the basic state G.

Figure 5:
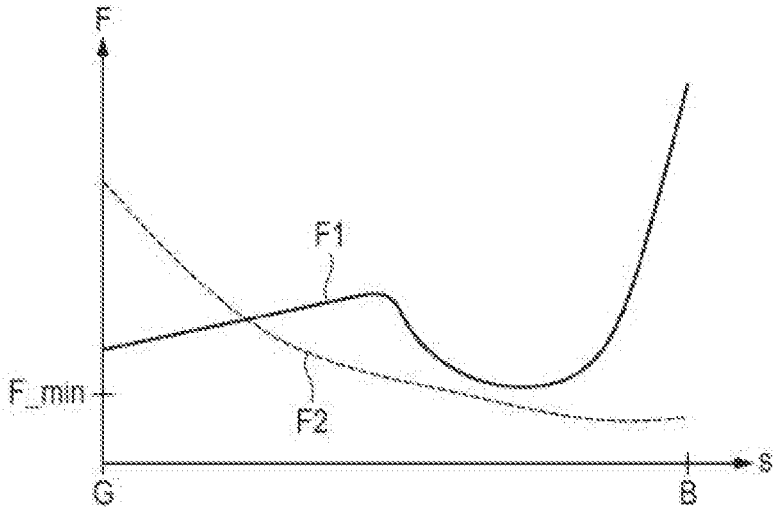
FIG. 5 shows a schematic illustration of a force/travel diagram for the embodiment of FIG. 3.

FIG. 5 shows a corresponding force/travel diagram for the embodiment in FIG. 3 in which the permanent magnets 41, 42 are arranged close to one another in the basic state G, and in the case of a movement of the activation element 22 they move apart from one another into the activation state B. As a result, the second counterforce F2 decreases in the course of the movement.

It is, of course, also possible to provide both a permanent magnet arrangement 40 corresponding to FIG. 1 and also corresponding to FIG. 3. As a result, a rise in the second counterforce F2 results both in the case of a movement of the activation element 22 toward the basic state G and toward the activation state B.

The mechanical counterforce generating device 30 and the permanent magnet arrangement 40 are preferably designed to generate the first counterforce F1 and the second counterforce F2 in such a way that together they are so large that a minimum force F, which is at least 6 N, preferably at least 8 N, is necessary to move the activation element 22 from the basic state G into the activation state B.

Of course, a variety of refinements and modifications are possible within the scope of the present invention.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. A key arrangement, comprising:

an activation element;

a switch;

a mechanical counterforce generating device; and a permanent magnet arrangement comprising a first permanent magnet and a second permanent magnet, wherein the switch has at least a first state and a second state, wherein the activation element has a basic state and an activation state and is configured to, in case of activation by a user, permit a movement from the basic state into the activation state, and in case of the movement into the activation state to permit a change in the state of the switch, wherein the mechanical counterforce generating device is configured to generate, in case of an activation of the activation element, a first counterforce at least in certain areas, and wherein the permanent magnet arrangement is configured to generate by an interaction between the first permanent magnet and the second permanent magnet, in case of activation of the activation element, a second counterforce at least in certain areas.

2. The key arrangement as claimed in claim 1, wherein the mechanical counterforce generating device is configured to generate the first counterforce at least so intensively that in case of non-activation the activation element is moved into the basic state even without the second counterforce.

3. The key arrangement as claimed in claim 1, wherein the mechanical counterforce generating device is configured to generate the first counterforce in such a way that it is non-linear over the movement profile from the basic state of the activation element to the activation state.

4. The key arrangement as claimed in claim 1, wherein the activation element is a rocker key.

5. The key arrangement as claimed in claim 1, wherein a mechanical stop is provided which, in the basic state, limits the movement of the activation element from the activation state to the basic state.

6. The key arrangement as claimed in claim 1, wherein the switch has a microswitch, a silicone switching mat, or a crack disk.

7. The key arrangement as claimed in claim 1, wherein the switch and the mechanical counterforce generating device are embodied as one structural unit.

8. The key arrangement as claimed in claim 1, wherein the mechanical counterforce generating device has an elastic element configured to at least partially generate the first counterforce.

9. The key arrangement as claimed in claim 8, in which the elastic element has a spring element.

10. The key arrangement as claimed in claim 1, wherein the mechanical counterforce generating device has a damping element configured to damp a movement of the activation element from the basic state into the activation state.

11. The key arrangement as claimed in claim 10, wherein the damping element has a hydraulic damping element, a pneumatic damping element, or a friction damping element.

12. The key arrangement as claimed in claim 1, wherein the mechanical counterforce generating device and the permanent magnet arrangement are configured to generate the first counterforce and the second counterforce in such a way that together they are so large that a minimum force, which is at least 6 N, is necessary to move the activation element from the basic state into the activation state.

13. The key arrangement as claimed in claim 12, wherein the minimum force is at least 8 N.

14. The key arrangement as claimed in claim 1, wherein the first permanent magnet is connected to the activation element and the second permanent magnet is arranged in such a way that it interacts with the first permanent magnet, and wherein in case of movement of the activation element, a movement of the first permanent magnet takes place relative to the second permanent magnet.

15. The key arrangement as claimed in claim 14, wherein the first permanent magnet is arranged relative to the second permanent magnet in such a way that the first permanent magnet and the second permanent magnet attract one another and in that in case of movement of the activation element from the basic state into the activation state the first permanent magnet and the second permanent magnet move away from one another, at least in certain areas.

16. The key arrangement as claimed in claim 14, wherein the first permanent magnet is arranged relative to the second permanent magnet in such a way that the first permanent magnet and the second permanent magnet repel one another, and in that in case of movement of the activation element from the basic state into the activation state the first permanent magnet and the second permanent magnet move toward one another at least in certain areas.

17. A key arrangement, comprising:

an activation element;

a switch;

a mechanical counterforce generating device; and a permanent magnet arrangement comprising a first permanent magnet and a second permanent magnet, the first permanent magnet being connected to the activation element and the second permanent magnet being arranged in such a way that it interacts with the first permanent magnet, wherein the first permanent magnet is arranged relative to the second permanent magnet in such a way that the first permanent magnet and the second permanent magnet attract one another, wherein the switch has at least a first state and a second state, wherein the activation element has a basic state and an activation state and is configured to, in case of activation by a user, permit a movement from the basic state into the activation state, and in case of the movement into the activation state to permit a change in the state of the switch, wherein the mechanical counterforce generating device is configured to generate, in case of an activation of the activation element, a first counterforce at least in certain areas, wherein the permanent magnet arrangement is configured to generate, in case of activation of the activation element, a second counterforce at least in certain areas, and wherein in case of movement of the activation element from the basic state into the activation state, the first permanent magnet and the second permanent magnet move away from one another, at least in certain areas.

18. A key arrangement, comprising:

an activation element;

a switch;

a mechanical counterforce generating device; and a permanent magnet arrangement comprising a first permanent magnet and a second permanent magnet, the first permanent magnet being connected to the activation element and the second permanent magnet being arranged in such a way that it interacts with the first permanent magnet, wherein the first permanent magnet is arranged relative to the second permanent magnet in such a way that the first permanent magnet and the second permanent magnet repel one another, wherein the switch has at least a first state and a second state, wherein the activation element has a basic state and an activation state and is configured to, in case of activation by a user, permit a movement from the basic state into the activation state, and in case of the movement into the activation state to permit a change in the state of the switch, wherein the mechanical counterforce generating device is configured to generate, in case of an activation of the activation element, a first counterforce at least in certain areas, wherein the permanent magnet arrangement is configured to generate, in case of activation of the activation element, a second counterforce at least in certain areas, and wherein in case of movement of the activation element from the basic state into the activation state, the first permanent magnet and the second permanent magnet move toward one another at least in certain areas.

* * * * *